United States Patent [19]

Kuse et al.

[11] Patent Number: 4,778,748

[45] Date of Patent: Oct. 18, 1988

[54] METHOD FOR PROCESSING LIGHT-SENSITIVE SILVER HALIDE COLOR PHOTOGRAPHIC MATERIAL

[75] Inventors: Satoru Kuse; Shigeharu Koboshi; Kazuhiro Kobayashi, all of Hino, Japan

[73] Assignee: Konishiroku Photo Industries, Co., Ltd., Tokyo, Japan

[21] Appl. No.: 8,142

[22] Filed: Jan. 22, 1987

Related U.S. Application Data

[63] Continuation of Ser. No. 847,130, Apr. 1, 1986, abandoned, which is a continuation-in-part of Ser. No. 752,919, Jul. 8, 1985, abandoned.

[30] Foreign Application Priority Data

Jul. 13, 1984 [JP] Japan ..... 59-146325

[51] Int. Cl.[4] ..... G03C 1/02; G03C 5/24; G03C 7/40; G03C 11/00

[52] U.S. Cl. ..... 430/428; 430/372; 430/421; 430/432; 430/463; 430/585; 430/588

[58] Field of Search ..... 430/432, 463, 372, 425, 430/585, 588, 428

[56] References Cited

U.S. PATENT DOCUMENTS

| | | | |
|---|---|---|---|
| 2,000,353 | 5/1935 | Schaeffer et al. | 430/493 |
| 3,157,502 | 11/1964 | Jonker et al. | 430/493 |
| 3,335,004 | 8/1967 | Wrisley et al. | 430/376 X |
| 3,356,502 | 12/1967 | Nasu et al. . | |
| 3,545,970 | 12/1970 | Giorgianni et al. | 430/376 |
| 3,741,763 | 6/1973 | Amano et al. . | |
| 4,025,347 | 5/1977 | Beretta et al. | 430/588 |
| 4,059,446 | 11/1977 | Hazenbosch et al. . | |
| 4,265,431 | 5/1981 | Falomo | 260/101 |
| 4,267,255 | 5/1981 | Schreiber | 430/493 |
| 4,279,880 | 7/1981 | Aoki et al. | 430/372 X |
| 4,284,709 | 8/1981 | Tomka | 430/493 |
| 4,336,324 | 6/1982 | Koboshi et al. . | |
| 4,551,424 | 11/1985 | Ikeda et al. | 430/588 |
| 4,555,481 | 11/1985 | Ukai et al. | 430/588 X |
| 4,555,482 | 11/1985 | Inoue et al. | 430/588 X |
| 4,623,613 | 11/1986 | Ishikawa et al. | 430/463 |
| 4,687,731 | 8/1987 | Ishikawa et al. | 430/463 |

FOREIGN PATENT DOCUMENTS

| | | |
|---|---|---|
| 0197540 | 12/1982 | Japan . |
| 0147738 | 9/1983 | Japan . |
| 0147739 | 9/1983 | Japan . |
| 0091440 | 5/1984 | Japan . |
| 1111428 | 7/1965 | United Kingdom . |
| 1353805 | 5/1974 | United Kingdom . |
| 1387713 | 3/1975 | United Kingdom . |

OTHER PUBLICATIONS

S. R. Goldwasser, "Water Flow Rate in Imersion-Washing Motion Picture Film", SMPTE, vol. 64, pp. 248–253, May, 1955.

Patent Abstracts of Japan, vol. 7, No. 266, 26th Nov., 1983.

Patent Abstracts of Japan, vol. 8, No. 48, 3rd of Mar., 1984.

Research Disclosure, No. 131, Mar. 1975, p. 46.

*Primary Examiner*—Mukund J. Shah

*Attorney, Agent, or Firm*—Frishauf, Holtz, Goodman & Woodward

[57] ABSTRACT

A method for processing a light-sensitive silver halide photographic material, which comprises processing a light-sensitive silver halide photographic material subjected to imagewise exposure with a processing solution having fixing ability, and thereafter processing the material with a first stabilizing solution having a surface tension of 20 to 78 dyne/cm and a second stabilizing solution having a surface tension of 8 to 60 dyne/cm substantially without performing the water washing step.

19 Claims, No Drawings

METHOD FOR PROCESSING LIGHT-SENSITIVE SILVER HALIDE COLOR PHOTOGRAPHIC MATERIAL

This application is a continuation of application Ser. No. 847,130, filed Apr. 1, 1986, which is a continuation-in-part of Ser. No. 752,919 filed July 8, 1985 both now abandoned.

BACKGROUND OF THE INVENTION

This invention relates to a method for processing a light-sensitive silver halide photographic material (hereinafter referred to as a light-sensitive material), more particularly to a method for processing a light-sensitive silver halide photographic material which has omitted the water washing processing step and can give a light-sensitive material with little contamination generated on its surface and also improved in stain caused by the sensitizing dye.

Light-sensitive materials are generally processed after imagewise exposure according to the processing steps of color developing, bleaching, fixing, stabilizing, bleach-fixing, water washing, etc. In the water washing step subsequent to the processing with a processing solution having fixing ability, a thiosulfate which is a compound reactive with a silver halide to form a water-soluble complex, other water-soluble silver complexes and further sulfites or metabisulfites as preservative may be contained in or attached on the light-sensitive material to be entrained into the water washing step, thereby leaving deleterious influences on the storability of images if the amount of washing water is small, as is well known in the art. Accordingly, for improving such a drawback, the salts as mentioned above are washed away from the light-sensitive material by use of a large amount of running water in washing after processing with a processing solution having fixing ability. However, in recent years, due to economical reasons such as shortage in water resources, increased costs in sewage fees and utilities as well as environmental reasons, it has been desired to employ processing steps in which the amount of washing water is reduced and countermeasures against pollution are taken.

In the prior art, as such countermeasures, for example, a method has been proposed in which water is permitted to flow countercurrently with the use of a water washing tank made to have a multi-stage structure as disclosed in West German Pat. No. 29 20 222 and S. R. Goldwasser "Water Flow Rate in Immersion-Washing of Motion Picture Film", SMPTE. Vol. 64, pp. 248–253, May (1955), etc.

Also known is a method in which a preliminary water washing is provided immediately after the fixing bath to reduce the polluting components contained in or attached on the light-sensitive material and entrained into the water washing step and also reduce the amount of washing water.

However, these techniques are not the processing methods in which no washing water is employed at all. Thus, under the situation in recent years, where water resources are exhausted and the cost for washing with water is increasing due to cost-up of crude oil, this problem is becoming more serious.

On the other hand, there is the processing method in which stabilizing processing is performed immediately after photographic processing without washing with water. For example, silver stabilizing processing with a thiocyanate has been known as disclosed in U.S. Pat. No. 3,335,004. However, this method involves the drawback of causing contamination on the surface of a light-sensitive material after drying, because a large amount of inorganic salts is contained in the stabilizing bath. Further, other disadvantages such as generation of stain and accompaniment of deterioration of dye images during prolonged storage proved to be involved when these stabilizing processings were performed.

SUMMARY OF THE INVENTION

Accordingly, an object of the present invention is to provide a method for processing a light-sensitive material substantially without use of washing water, which is small in energy cost and pollution load.

Another object of the present invention is to provide a method for processing a light-sensitive material, which is free from generation of contamination on the surface of the light-sensitive material and improved in reduced stain generation even by using substantially no washing water.

Still another object of the present invention is to provide a method for processing a light-sensitive material, which is improved in deterioration of dye images during prolonged storage even by using substantially no washing water.

The present inventors have made extensive studies and consequently found that the above objects can be accomplished by processing a light-sensitive silver halide photographic material subjected to imagewise exposure with a processing solution having fixing ability, and thereafter processing said material with a first stabilizing solution having a surface tension of 20 to 78 dyne/cm and a second stabilizing solution having a surface tension of 8 to 60 dyne/cm substantially without performing the water washing step.

Further, according to a preferred embodiment, it has also been found that the objects of the present invention can be accomplished more effectively when the first stabilizing solution is endowed with at least one fungicidal importing means as shown below:

[fungicidal means]

(A) means for adding on fungicide;

(B) means for passing through a magnetic field; and (C) means for irradiating UV-ray.

Further, according to another preferred embodiment, it has also been found that the objects of the present invention can be accomplished more effectively when the above second stabilizing solution contains $0.7\times10^{-5}$ to $1500\times10^{-5}$ mole/liter of a thiosulfate.

Further, according to still another preferred embodiment of the present invention, the objects of the present invention can be accomplished more effectively when said light-sensitive silver halide photographic material contains at least one of the compounds represented by the formula [I] shown below:

Formula [I]

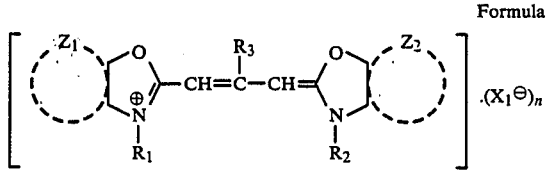

wherein each of $Z_1$ and $Z_2$ represents a group of atoms necessary for formation of a benzene ring or a naphthalene ring fused to the oxazole ring; each of $R_1$ and $R_2$ represents an alkyl group, an alkenyl group or an aryl group; $R_3$ represents a hydrogen atom or an alkyl group having 1 to 3 carbon atoms; $X_1\ominus$ represents an anion; and n is 0 or 1.

DETAILED DESCRIPTION OF THE INVENTION

This invention will be explained in detail below. The stabilizing processing omitting substantially the water washing step brings about a large amount of the components of fixing solution or bleach-fixing solution or soluble silver complexes and decomposed products thereof into the stabilizing solution as described above in the case of continuous process where stabilizing processing is performed directly after processing with a fixing or bleach-fixing processing, whereby these components will be attached on the surface of a light-sensitive material to cause contamination thereon after processing. Particularly, in the case of a light-sensitive material having a transparent support, such contamination poses a great problem.

Accordingly, it has been generally practiced to use a processing method which permit none of fixing solution or bleach-fixing solution components and soluble silver complexes to be attached at all so that no such contamination may be caused; namely, the method to perform thorough washing with water. However, these methods are opposed to the objects of cost reduction and lowering in pollution as mentioned above. Therefore, contamination on the light-sensitive material surface after processing (particularly in the case of a light-sensitive material having a transparent support) and the stabilizing processing with low cost and lowered pollution have been considered to be antagonistic to each other and, in spite of a large number of studies hitherto made, no satisfactory result has yet been obtained. Further, in performing such a stabilizing process, another problem of stain generation, which is considered to be caused by a sensitizing dye, has newly been found, and it has been found very important to solve this problem.

The present inventors have made extensive studies in order to overcome these problems, and consequently found a surprising fact that the above objects of the present invention could be accomplished by use of two different kinds of stabilizing solutions having surface tensions within specific ranges, respectively, substantially without performing the water washing step, to accomplish the present invention. This fact was surprising and entirely unexpected from the knowledge in the prior art.

The surface tension of the stabilizing solution to be used for the processing of the present invention is measured according to the general measuring method as described in "Analysis and Testing Method of Surfactants" (by Fumio Kitahara, Shigeo Hayano & Ichiro Hara, published on Mar. 1, 1982, by Kodansha K.K.), etc., and it is the value obtained according to the conventional general measuring method at 20° C. in the present invention.

Each of the first stabilizing solution and the second stabilizing solution of the present invention may be contained in either a single tank or a multi-stage tank. In the case of a multi-stage tank, there may be employed a countercurrent system in which supplemental solution is supplemented from the tank in the final stage and transferred successively through the overflow to the tanks in the preceding stages. However, the system of overflow may also include, in addition to the system in which overflow is conducted simply, the system in which overflow is substantially effected. For example, the solution once overflowed is pooled and then permitted to flow successively into the tanks in the preceding stages by means of bellows pump, etc.

The first stabilizing solution tank and the second stabilizing solution tank are independent of each other. If the overflowed solution in the second stabilizing solution tank is permitted to flow into the first stabilizing solution or, vice versa, the overflowed solution in the first stabilizing solution tank is permitted to flow into the second stabilizing solution, troubles such as generation of contamination on the surface of a light-sensitive material, deterioration in storability of stabilizing solution, etc. will occur. Thus, in the present invention, it is essentially required that both stabilizing solution tanks should be independent of each other.

The second stabilizing solution of the present invention may be a solution of any material which can give a surface tension of 8 to 60 dyne/cm (20° C.), above all preferably a surfactant. Particularly, at least one compound selected from the compounds of the formula [II], the formula [III] shown below and water-soluble organic siloxane compounds may be used particularly preferably for attaining the object of the present invention.

$$A—O—(B)_m—X_2 \qquad \text{Formula [II]}$$

In the above formula, A represents a monovalent organic group, for example, an alkyl group having 6 to 20, preferably 6 to 12, carbon atoms, such as hexyl, heptyl, octyl, nonyl, decyl, undecyl, dodecyl or the like; or an aryl group substituted with alkyl groups having 3 to 20 carbon atoms, preferably alkyl groups having 3 to 12 carbon atoms, such as propyl, butyl, pentyl, hexyl, heptyl, octyl, nonyl, decyl, undecyl, dodecyl or the like. The aryl group may be phenyl, tolyl, xylyl, biphenyl or naphthyl, etc., preferably phenyl or tolyl. The position of the aryl group at which the alkyl groups are bonded may be either ortho-, meta- or para-position. B represents ethylene oxide or propylene oxide, and m represents an integer of 4 to 50. $X_2$ represents a hydrogen atom, $SO_3Y$ or $PO_3Y_2$, and Y represents a hydrogen atom, an alkali metal (Na, K or Li, etc.) or an ammonium ion.

$$R_7—\overset{\overset{R_4}{|}}{\underset{\underset{R_5}{|}}{N}}{}^{\oplus}—R_6.X_3{}^{\ominus} \qquad \text{Formula [III]}$$

In the above formula, each of $R_4$, $R_5$, $R_6$ and $R_7$ represents a hydrogen atom, an alkyl group or a phenyl group, and the total number of the carbon atoms of $R_4$, $R_5$, $R_6$ and $R_7$ is 3 to 50. $X_3$ represents an anion such as a halogen atom, a hydroxy group, a sulfate group, a carbonate group, a nitrate group, an acetate group, a p-toluenesulfonate group, etc.

The water-soluble organic siloxane compound of the present invention means water-soluble organic siloxane compounds in general as disclosed in, for example, Japanese Provisional Patent Publication No. 18333/1972, Japanese Patent Publication No. 51172/1980, Japanese Patent Publication No. 37538/1976, Japanese Provisional Patent Publication No. 62128/1974 and U.S. Pat. No. 3,545,970.

In the following, typical examples of the compounds represented by the formulae [II] and [III], and water-soluble organic siloxane compounds are enumerated, but the compounds according to the present invention are not limited thereto.

Exemplary compounds represented by the formula [II]

$C_{12}H_{25}O(C_2H_4O)_{10}H$ II-1
$C_8H_{17}O(C_{13}H_6O)_{15}H$ II-2
$C_9H_{19}O(C_2H_4O)_4SO_3Na$ II-3
$C_{10}H_{21}O(C_2H_4O)_{15}PO_3Na_2$ II-4

II-5

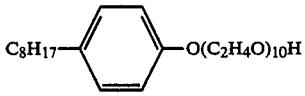

II-6

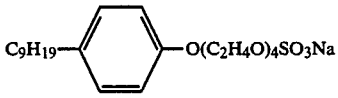

II-7

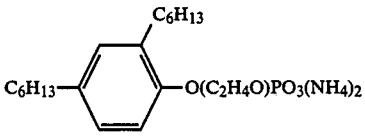

II-8

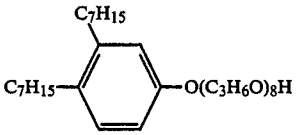

II-9

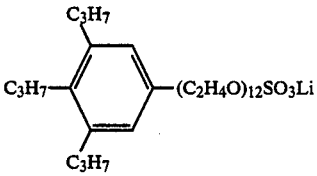

II-10

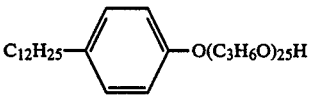

II-11

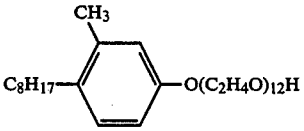

II-12

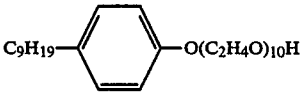

Exemplary compounds represented by the formula [III]

III-1

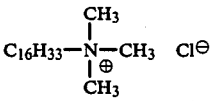

-continued

Exemplary compounds represented by the formula [III]

III-2

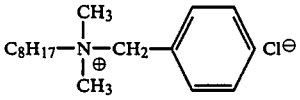

III-3

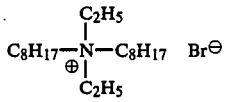

III-4

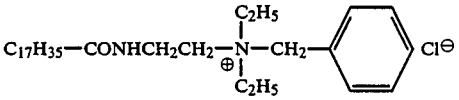

III-5

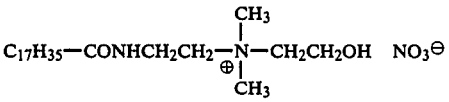

III-6

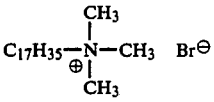

III-7

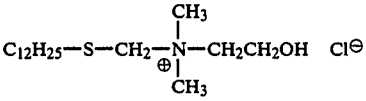

III-8

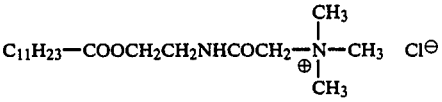

III-9

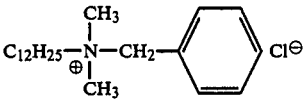

III-10

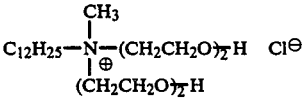

Water-soluble organic siloxane compounds

IV-1

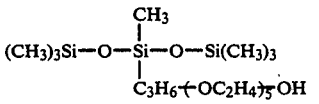

IV-2

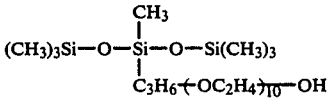

IV-3

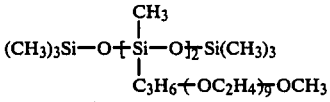

-continued

Water-soluble organic siloxane compounds

IV-4

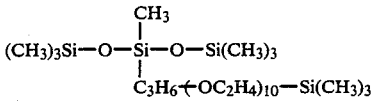

IV-5

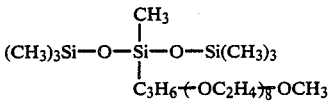

IV-6

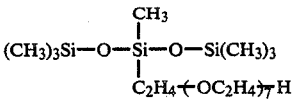

IV-7

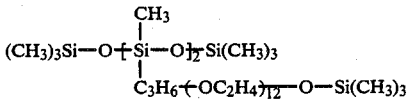

IV-8

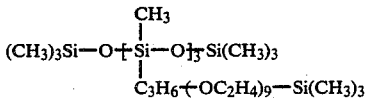

IV-9

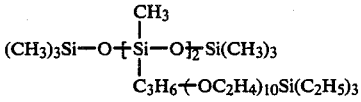

IV-10

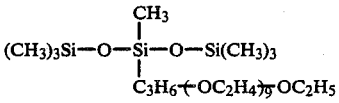

IV-11

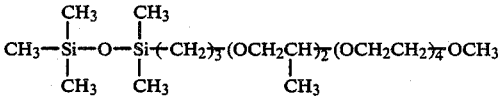

IV-12

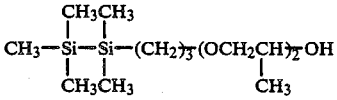

IV-13

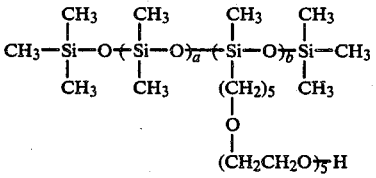

a + b = 30

IV-14

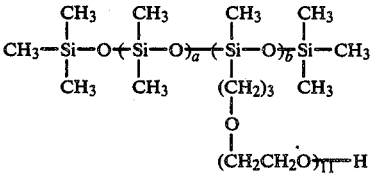

a + b = 41

Of the above water-soluble organic siloxane compounds, above all the compounds represented by the formula [IV] shown below may more preferably be used for bringing about advantageously the desired effect of the present invention.

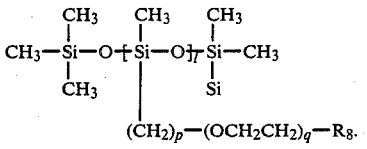

Formula [IV]

In the above formula, $R_8$ represents a hydrogen atom, a hydroxy group, a lower alkyl group, an alkoxy group,

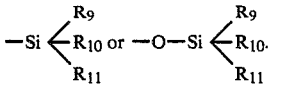

Each of $R_9$, $R_{10}$ and $R_{11}$ represents a lower alkyl group (preferably an alkyl group having 1 to 3 carbon atoms such as methyl, ethyl or propyl), and the above $R_9$, $R_{10}$ and $R_{11}$ may be the same or different. l represents an integer of 1 to 4, and each of p and q represents an integer of 1 to 15.

In the present invention, of these compounds capable of giving a surface tension of the second stabilizing solution of 8–60 dyne/cm, above all those capable of giving a surface tension of 15–45 dyne/cm may particularly preferably be employed for the effect of the present invention.

These compounds represented by the above formulae [II], [III] and water-soluble organic siloxane compounds may be used either singly or in combination. Further, they can be added in amounts within the range from 0.01 to 20 g per liter of the stabilizing solution to exhibit good effect.

For the first stabilizing solution of the present invention, any solution may be used, which has a surface tension of 20–78 dyne/cm (20° C.). For example, mere water may be used. In the present invention, of the compounds capable of giving a surface tension of the first stabilizing solution of 20–78 dyne/cm, above all those capable of giving a surface tension of 50–75 dyne/cm may particularly preferably be employed for the effect of the present invention.

As the compounds to be added into the first and second stabilizing solution, in addition to those as mentioned above, there may be added various additives for improving and expanding the processing effect, such as fluorescent whitening agents; organic sulfur compounds; onium salts; film hardeners; chelating agents; pH regulators such as boric acid, citric acid, phosphoric acid, acetic acid, or sodium hydroxide, sodium acetate, potassium citrate, etc.; organic solvents such as methanol, ethanol, dimethyl sulfoxide, etc.; dispersants such as ethylene glycol, polyethylene glycol, etc.; color controllers, etc., as desired.

The method for feeding the stabilizing solution according to the present invention may preferably be practiced in the case of a multi-stage countercurrent system by feeding it into the later bath, which is then subjected to overflow from the former bath. Also, as the method for adding the above compounds, there may be employed any one of the methods in which they are fed as concentrated solutions into the stabilizing tank, the method in which the above compounds and other additives are added to the stabilizing solution to be fed into the stabilizing tank to provide a feed solution for the stabilizing solution, or the method in which they are added in the bath precedent to the stabilizing processing step to be incorporated in the light-sensitive material to be processed, or other various methods.

In the present invention, the pH values of the respective stabilizing solutions may preferably be 4 to 9. This is because silver sulfide tends to be generated at a pH lower than 4 to cause problems such as clogging of the filter, while water slime or microorganism tend to be generated at a pH over 9. Thus, the stabilizing solutions of the present invention are used in the pH range from 4 to 9.

The pH may be regulator by use of a pH controller as mentioned above.

The processing temperature in each stabilizing processing may be in the range of 15° C. to 60° C., preferably from 20° C. to 45° C. The processing time, which should preferably be as short as possible from the viewpoint of rapid processing, may generally be 20 seconds to 10 minutes, most preferably one minute to 5 minutes, with shorter processing time being preferred for the earlier stage tank and longer processing time for the later stage tank.

The processing solution having fixing ability in the present invention refers to a processing solution containing a solubilizing complexing agent which is solubilized as silver halide complex, including not only fixing solutions in general but also bleach-fixing solutions, one bath developing-fixing solution and one bath developing-bleach-fixing solution. Preferably, the effect of the present invention may be greater, when processed by use of a bleach-fixing solution or a fixing solution. As the solubilizing complexing agent, there may be included, for example, thiosulfates such as potassium thiosulfate, sodium thiosulfate, and ammonium thiosulfate; thiocyanates such as potassium thiocyanate, sodium thiocyanate, etc., ammonium thiocyanate; or thiourea, thioether, highly concentrated bromides, iodides, etc. as typical examples. Particularly, the fixing solution should desirably contain a thiosulfate for obtaining better results with respect to the desired effect of the present invention.

In the present invention, "substantially without performing the water washing step" means carrying out the first and second stabilizing processings using a single tank or multi-tank countercurrent system after processing with a processing solution having fixing ability, but there may also be included the processing steps other than water washing in general, such as rinsing processing, auxiliary water washing and known water washing promoting bath, etc.

After each stabilizing processing by the present invention, no water washing processing is required, but it is possible to provide a processing tank for the purpose of rinsing with a small amount of water within a very short time, surface washing with a sponge and image stabilization of controlling the surface characteristics of the light-sensitive material.

In the present invention, when a specific chelating agent is used in the first stabilizing solution, there is another effect of improvement of storage stability of said first stabilizing solution.

The chelating agent preferably used in the first stabilizing solution of the present invention has a chelate stability constant of 8 or higher with iron (III) ions.

The chelate stability constant as mentioned in the present invention indicates the stability of a complex of a metal ion and the chelate in a solution, which means the constant defined as the reciprocal of the dissociation constant of the complex, as generally known from L. G. Sillen & A. E. Martell, "Stability Constants of Metal Ion Complexes", The Chemical Society London (1964), and S. Chaberek, A. E. Martell "Organic Sequestering Agents" Wiley (1959), etc. The chelating agents having chelate stability constants with iron (III) ions of 8 or more of the present invention may include polyphosphates, aminopoly-carboxylates, oxycarboxylates, polyhydroxy compounds, organic phosphates, fused phosphates, etc. Particularly, good results can be obtained when aminopolycarboxylates or organic phosphates are employed. Specific examples of chelating agents are set forth below, but the present invention is not limited thereto.

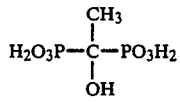
(1)

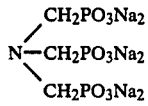
(2)

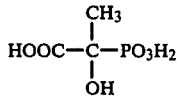
(3)

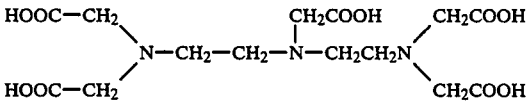
(4)

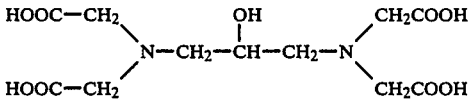
(5)

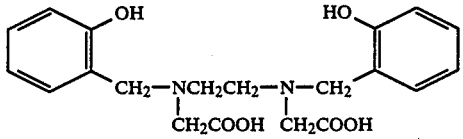
(6)

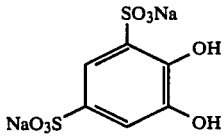
(7)

The chelating agent may be used either singly or as a combination of two or more compounds, and its amount added may be within the range of 0.05 g to 40 g, preferably 0.1 to 20 g, per liter of the stabilizing solution.

Of these chelating agents, particularly preferred is 1-hydroxyethylidene-1,1-diphosphonic acid.

The amount of the first and second stabilizing solutions supplemented may be each 6000 ml of less per 1 $m^2$ of the light-sensitive material, preferably 20 ml to 4000 ml to exhibit preferably the desired effect of the present invention.

The "substantial water washing step" as mentioned in the present invention means the step in which the material to be supplemented is water and its amount supplemented exceeds 6000 ml per 1 $m^2$ of the light-sensitive material.

The fungicide to be preferably used in each stabilizing solution of the present invention may include hydroxybenzoic acid ester compounds, phenolic compounds, thiazole compounds, pyridine compounds, guanidine compounds, carbamate compounds, morpholine compounds, quaternary phosphonium compounds, ammonium compounds, urea compounds, isoxazole compounds, propanolamine compounds, sulfamide compounds and amino acid compounds.

The aforesaid hydroxybenzoic acid ester compounds may include methyl ester, ethyl ester, propyl ester, butyl ester, etc. of hydroxybenzoic acid, preferably n-butyl ester, isobutyl ester and propyl ester of hydroxybenzoic acid, more preferably a mixture of the three kinds of esters of hydroxybenzoic acid as mentioned above.

The phenolic compounds may be exemplified by phenol compounds which may have $C_1$–$C_6$ alkyl groups, halogen atoms, a nitro group, a hydroxy group, a carboxyl group, an amino group, an alkoxy group, a cycloalkyl group or a phenyl group, etc. as substituent, preferably o-phenylphenol, o-cyclohexylphenol, nitrophenol, chlorophenol, cresol, guaiacol, aminophenol and phenol.

The thiazole compounds are compounds having a nitrogen atom and a sulfur atom in five-membered ring, including preferably 1,2-benzisothiazoline-3-one, 2-methyl-4-isothiazoline-3-one, 2-octyl-4-isothiazoline-3-one, 5-chloro-2-methyl-4-isothiazoline-3-one, 2-chloro-4-thiazolyl-benzimidazole.

Pyridine compounds may include specifically 2,6-dimethylpyridine, 2,4,6-trimethylpyridine, sodium-2-pyridinethiol-1-oxide, etc., preferably sodium-2-pyridinethiol-1-oxide.

Guanidine compounds may include specifically cyclohexydine, polyhexamethylene biguanidine hydrochloride, dodecylguanidine hydrochloride, preferably dodecyl guanidine and salts thereof.

The carbamate compounds may include specifically methyl-1-(butylcarbamoyl)-2-benzimidazolecarbamate, methylimidazolecarbamate, etc.

Typical examples of morpholine compounds are 4-(2-nitrobutyl)morpholine, 4-(3-nitrobutyl)morpholine, etc.

Quaternary phosphonium compounds may include tetraalkylphosphonium salts, tetraalkoxyphosphonium salts, etc., preferably tetraalkylphosphonium salts, more specifically preferably tri-n-butyl-tetradecylphosphonium chloride, tri-phenyl-nitrophenylphosphonium chloride.

Quaternary ammonium compounds may include benzalconium salts, benzethonium salts, tetraalkylammonium salts, alkylpyridinium salts, specifically dodecyldimethylbenzylammonium chloride, didecyldimethylammonium chloride, laurylpyridinium chloride and the like.

Typical example of urea compounds are N-(3,4-dichlorophenyl)-N'-(4-chlorophenyl)urea and N-(3-trifluoromethyl-4-chlorophenyl)-N'-(4-chlorophenyl-)urea, etc.

Isooxazole compounds may include typically 3-hydroxy-5-methylisoxazole, etc.

Propanolamine compounds may include n-propanols and isopropanols, specifically DL-2-benzylamino-1-propanol, 3-diethylamino-1-propanol, 2-dimethylamino-2-methyl-1-propanol, 3-amino-1-propanol, isopropanolamine, diisopropanolamine, N,N-dimethylisopropanolamine, etc.

Sulfamide compounds may include o-nitrobenzene sulfamide, p-aminobenzene sulfamide, 4-chloro-3,5-dinitrobenzene sulfamide, α-amino-p-toluene sulfamide and the like.

Typical example of amino acid compounds is N-lauryl-β-alanine.

Among the fungicides as mentioned above, those preferably used in the present invention are thiazole compounds, pyridine compounds, guanidine compounds, and quaternary ammonium compounds. Further, particularly preferred are thiazole compounds.

The amount of the fungicide to be added into the stabilizing solution, if it is less than 0.002 g per liter of the stabilizing solution, cannot exhibit the desired effect of the present invention, while an amount over 50 g is disadvantageous in cost and also deteriorates contrariwise the storage stability of the dye image. Thus, it is employed in an amount within the range from 0.002 g to 50 g, preferably from 0.005 g to 10 g.

Passing of the stabilizing solution through a magnetic field as herein mentioned refers to passing of the stabilizing solution through a magnetic field generated between the positive pole and the negative pole of a magnet, and the light-sensitive material may be either passed therethrough or not.

The magnetic field to be used in the present invention may be obtained by use of permanent magnets, etc. comprising iron, cobalt, nickel, or by passing direct current through a coil, and it is not particularly limited but all the means capable of forming a magnetic field may be available. The magnetic field may be formed either by use of one magnet to form lines of magnetic force or by use of two magnets (positive pole and negative pole) confronted to each other to form lines of magnetic force between the confronted magnets.

As the method for passing the stabilizing solution to be used in the present invention through a magnetic field, there may be employed the method in which a permanent magnet, etc. for forming the magnetic field is used and the permanent magnet provided in and/or outside of the stabilizing solution is moved (including rotation), or the method in which the stabilizing solution is moved by stirring or circulation. A particularly desirable method is to fix a permanent magnet on a part or all of the inner portion or outer portion of the circulation system pipe and circulate the stabilizing solution. For fixing individually on the whole pipe, the pipe itself may be a permanent magnet or alternatively said permanent magnets may be mounted on the whole of said pipe.

In the case of an automatic processing machine, the object can be accomplished by providing permanent magnets, etc. in the stabilizing bath, but it is preferred to provide them in the circulation system for the stabilizing bath as mentioned above (not limited to the circulation pipe, but also inclusive of tanks or other members in the course of circulation). When the stabilizing processing step is a multi-stage stabilizing bath, it is most preferred to pass the stabilizing solution in all the stabilizing baths through a magnetic field, but it is also preferred to pass the stabilizing solution in the stabilizing baths other than the stabilizing bath nearest to the processing solution having fixing ability. The stabilizing bath itself, preferably inside of the stabilizing bath may be supplied with a resin lining incorporating a material capable of generating lines of magnetic force therein, and this lining can also be applied on the circulation system. Thus, the stabilizing solution can be passed through a magnetic field.

Irradiation by UV-rays of the stabilizing solution may be practiced in the present invention by means of commercially available UV-ray lamps or UV-ray irradiating devices in general, preferably a UV-ray lamp with an output of 5 W to 800 W (tube output), to which the present invention is not limited.

Also, according to a preferred embodiment of the present invention, the UV-rays have a wavelength within the range from 220 nm to 350 nm. Further, as the irradiation method, UV-ray irradiating means may be placed in the stabilizing solution or outside of the stabilizing solution to effect direct irradiation thereon, or alternatively said UV-rays may be irradiated on the light-sensitive material to be processed.

These fungicidal means according to the present invention promote the desired effect of the present invention particularly when applied on the first stabilizing solution, but also particularly preferably used in the present invention when applied on the second stabilizing solution, since another effect of improvement of solution storability can be also added thereby.

In the processing of the present invention, silver may be recovered from the stabilizing solutions, as a matter of course, and also from the processing solutions containing soluble silver salts such as the fixing solution, the bleach-fixing solution, etc. according to various methods. For example, the electrolytic method (disclosed in French Pat. No. 2,299,667), the precipitation method (disclosed in Japanese Provisional Patent Publication No. 73037/1977, West German Pat. No. 23 31 220), the ion-exchange method (disclosed in Japanese Provisional Patent Publication No. 17114/1976, West German Pat. No. 25 48 237) and the metal substitution method (disclosed in British Pat. No. 1,353,805), etc. may effectively be utilized.

Further, in silver recovery, the above soluble silver salts may be subjected to silver recovery by recovering the overflowed processing solution according to the method as mentioned above, with the residual solution being either disposed as waste solution or used as supplemental solution or tank processing solution with addition of a regenerant. It is particularly preferred to mix the stabilizing solution with fixing solution or bleach-fixing solution before carrying out silver recovery.

It is also possible to treat the stabilizing solution of the present invntion by contact with ion-exchange resin, electrodialysis treatment (see Japanese Patent Application No. 96352/1984) or reverse osmosis treatment (see Japanese Patent Application No. 96352/1984), etc.

In the present invention, when the thiosulfate concentration in the second stabilizing solution is $0.7\times10^{-5}$ to $1500\times10^{-5}$ mole/l, the desired effect of the present invention can be improved, and still another effect of improvement of prolonged storability of the dye image is also exhibited, and therefore it is preferred to use a thiosulfate within the above range.

Further, particularly when a thiosulfate is employed within the range of from $2\times10^{-5}$ to $200\times10^{-5}$ mole/l, particularly good results can be obtained. The thiosulfate concentration in the second stabilizing solution of the present invention, when the second stabilizing solution is contained in two or more tanks, refers to the thiosulfate concentration in the tank nearest to the drying step, or, in the case of a single tank, to the thiosulfate concentration in the single tank.

In the present invention, among these embodiments, the second stabilizing tank consisting of a single tank is more preferred from the standpoint of making automatic processing machines more compact.

The first and second stabilizing tanks may also have a circulation lamp and a filter device arranged therein, as desired.

The processing steps in the present invention have the steps of processing with the first stabilizing solution and the second stabilizing solution after processing with a processing solution having fixing ability, and specific examples of the processing steps may include those as shown below, by which the present invention is not limited.

(1)
Color developing → Bleaching → Fixing →
First stabilizing → Second stabilizing → Drying.

(2)
Color developing → Bleach-fixing →
First stabilizing → Second stabilizing → Drying.

(3)
One bath color developing-bleach-fixing →
First stabilizing → Second stabilizing → Drying.

(4)
Color developing → Stopping → Bleach-fixing →
First stabilizing → Second stabilizing → Drying.

(5)
Color developing → Bleaching →
Fixing → Rinsing →
First stabilizing → Second stabilizing → Drying.

(6)
Color developing → Bleaching →
Neutralizing → Fixing →
First stabilizing → Second stabilizing → Drying.

The light-sensitive material to be used in the processing of the present invention may preferably contain a sensitizing dye represented by the formula [I] shown below:

Formula [I]

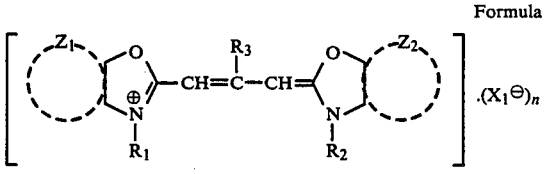

In the above formula, each of $Z_1$ and $Z_2$ represents a group of atoms necessary for forming a benzene ring or a naphthalene ring fused to the oxazole ring. The heterocyclic ring nucleus formed may be substituted with various substituents, preferably halogen atoms, aryl groups, alkenyl groups, alkyl groups or alkoxy groups. More preferable substituents may be halogen atoms, phenyl groups, methoxy groups, most preferably phenyl groups.

Preferably, both of $Z_1$ and $Z_2$ represent benzene rings fused to the oxazole rings, at least one of the benzene rings being substituted with a phenyl group at the 5-position of the benzene ring, or one benzene ring being substituted with a phenyl group at the 5-position and the other benzene ring with a halogen atom at the 5-position. Each of $R_1$ and $R_2$ represents an alkyl group, an alkenyl group or an aryl group, preferably an alkyl group. More preferably, each of $R_1$ and $R_2$ is an alkyl group substituted with a carboxyl group or a sulfo group, most preferably a sulfoalkyl group having 1 to 4 carbon atoms. Further, most preferably, it is sulfoethyl group. $R_3$ represents a hydrogen atom or an alkyl group having 1 to 3 carbon atoms, preferably a hydrogen atom or an ethyl group. $X_1^{\ominus}$ represents an anion, and n represents 0 or 1.

The sensitizing dye presented by the formula [I] to be used in the present invention may also be employed in the so-called color strengthening sensitizing combination in combination with the other sensitizing dye. In this case, the respective sensitizing dyes are dissolved in the same or different solvents, and these solutions may be mixed together before addtion to the emulsion, or alternatively they can be added separately to the emulsion. When added separately, the order of addition, the time intervals may be determined as desired depending on the purpose.

Specific Examples of the sensitizing dye represented by the formula [I] are shown below, but the sensitizing dyes to be used in the present invention are not limited to these compounds.

[I-1]

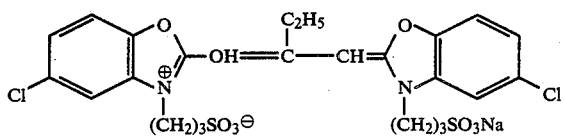

[I-2]

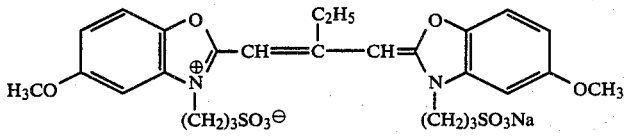

[I-3]

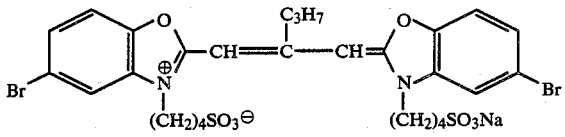

[I-4]

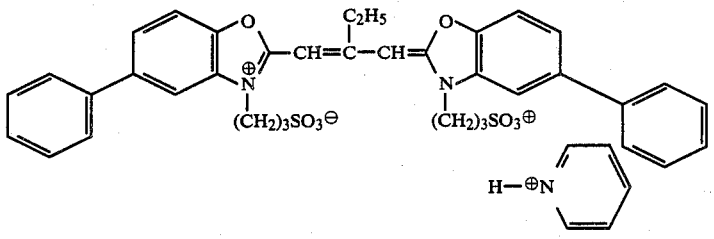

[I-5]

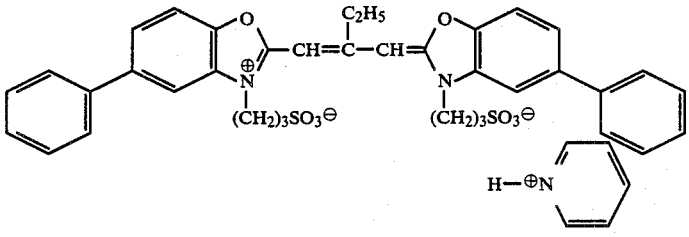

[I-6]

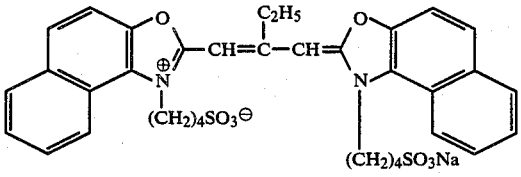

-continued

[I-7]

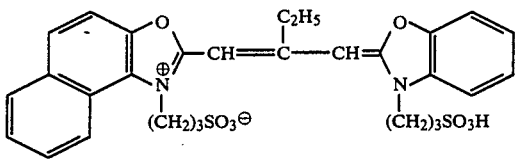

[I-8]

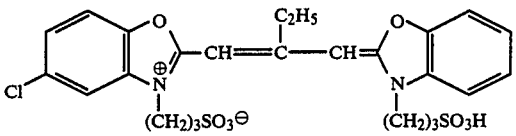

[I-9]

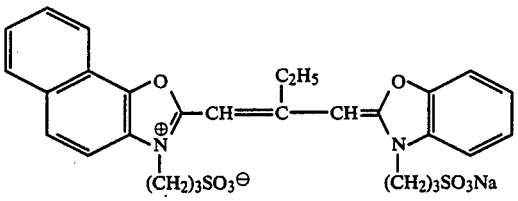

[I-10]

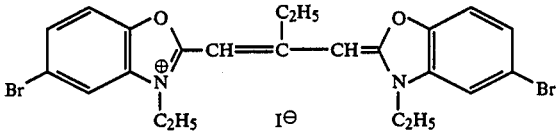

[I-11]

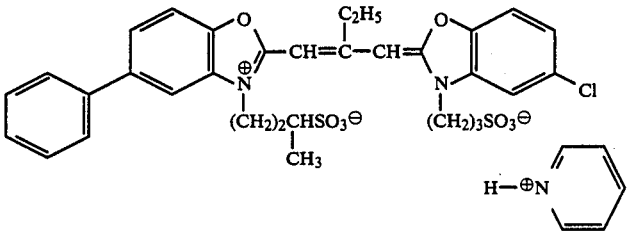

[I-12]

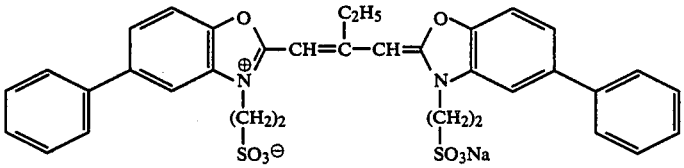

[I-13]

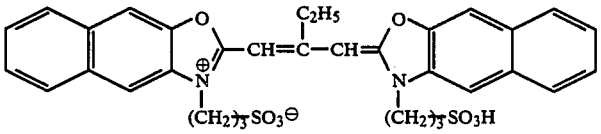

The timing at which the sensitizing dye represented by the above formula [I] is added to the emulsion may be at any time in the course of the step of preparing the emulsion, preferably during chemical ripening or after chemical ripening. Its amount added may preferably be $2\times10^{-6}$ mole to $1\times10^{-3}$ mole, further preferably $5\times10^{-6}$ mole to $5\times10^{-4}$ mole, per mole of silver halide.

The silver halide emulsion which can be used in the present invention may employ any of silver halides such as silver chloride, silver bromide, silver iodide, silver chlorobromide, silver chloroiodide, silver iodobromide, silver chloroiodobromide, etc. Also, as the protective colloid for these silver halides, in addition to natural products such as gelatin, etc., various synthetic compounds may be available. The silver halide emulsion may also contain conventional additives for photography such as stabilizers, sensitizers, film hardeners, sensitizing dyes, surfactants, etc.

As the support, there may be employed any material such as polyethylene-coated paper, triacetate film, polyethylene terephthalate film, while polyethylene terephthalate film, etc., but in the present invention, a material having a transparent support may particularly preferably be employed for the desired effect of the present invention.

The light-sensitive material for which the present invention is applicable may be any of light-sensitive materials such as color paper, reversal color paper, color positive film, color reversal film, direct positive paper, light-sensitive materials for diffusion photography, etc.

The present invention is described in detail below by referring to the following Examples, by which the embodiments of the present invention are not limited.

EXAMPLE 1

On a triacetate film base were provided a halation preventive layer and a gelatin layer, followed by coating of a green-sensitive silver halide emulsion layer thereon to a total silver quantity of 18 mg/100 $cm^2$.

As the magenta coupler, 6-methyl-3-(2,4,6-trimethyl)-benzyl-1H-pyrazolo-[3,2-C]-s-triazole was employed, and conventional additives such as a high boiling point solvent, a film hardener and an extenter were employed. As the sensitizing dye, the sensitizing dye SD-1 shown below was employed.

(SD-1)

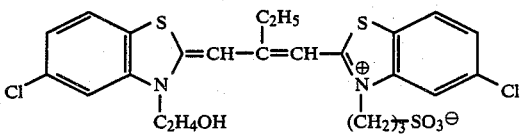

(hereinafter abbreviated to as SD-1).

Such an emulsion composition was applied on the base to prepare a sample of a silver halide color negative film light-sensitive material.

The above color negative film subjected to white grading exposure by means of KS-7 type sensitometer (produced by Konishiroku Photo Industry K.K.) was processed according to the following steps.

| Processing step (38° C.) | Number of tanks | Processing time |
|---|---|---|
| Color developing | 1 | 3 min. 15 sec. |
| Bleaching | 1 | 4 min. 20 sec. |
| Fixing | 1 | 3 min. 10 sec. |
| First stabilizing | 2 (cascade) | 1 min. 30 sec. |
| Second stabilizing | 1 | 30 sec. |

The color developing solution employed had the following composition.

| | |
|---|---|
| Potassium carbonate | 30 g |
| Sodium hydrogen carbonate | 2.5 g |
| Potassium sulfite | 5 g |
| Sodium bromide | 1.3 g |

-continued

| | |
|---|---|
| Potassium iodide | 1.2 mg |
| Hydroxylamine sulfate | 2.5 g |
| Sodium chloride | 0.6 g |
| Sodium diethylenetriaminepentaacetate | 2.0 g |
| 4-Amino-3-methyl-N—ethyl-N—(β-hydroxyethyl)aniline sulfate | 4.75 g |
| Potassium hydroxide | 1.2 g |

(made up to one liter with addition of water and adjusted to pH 10.06 by use of potassium hydroxide or 20% sulfuric acid).

The bleaching solution employed had the following composition.

| | |
|---|---|
| Ferric (III) ammonium ethylenediaminetetraacetate | 100 g |
| Ammonium bromide | 140 g |

(made up to one liter with addition of water and adjusted to pH 6.0 by use of glacial acetic acid and aqueous ammonia).

The fixing solution employed had the following composition.

| | |
|---|---|
| Ammonium thiosulfate | 180 g |
| Anhydrous sodium sulfite | 12 g |
| Potassium hydroxide | 1 g |
| Sodium carbonate | 8 g |

(made up to one liter with addition of water and adjusted to pH 7.4 by use of conc. aqueous ammonia or acetic acid).

As the first and the second stabilizing solutions, water adjusted to pH 7 by addition of 0.03% of the above fixing solution was employed. In the first and second solutions, the additives as shown in Table 1 were added and the surface tension at 20° C. of each solution was measured by a surface tensiometer before carrying out the processing of the color negative film sample following the processing steps as mentioned above.

For the film samples after processing, contamination attached on the film surface was observed.

Also, for the samples after completion of developing, the magenta density at the maximum density portion was measured by means of PDA-65 Model photoelectric densitometer (produced by Konishiroku Photo Industry Co., Ltd.) and then the samples were stored under a xenon light source (70,000 lux) at 60° C., 60% RH, and thereafter the portion previously measured was again subjected to measurement for determination of the fading percentage of the magenta density.

The results are summarized in Table 1.

TABLE 1

| Sample No. | Additive (amount) First stabilizing | Additive (amount) Second stabilizing | Surface tension (dyne/cm) First stabilizing | Surface tension (dyne/cm) Second stabilizing | Contamination on film surface*1 | Fading percentage of dye (%) |
|---|---|---|---|---|---|---|
| 1-1 (Comparative) | no addition | no addition | 70 | 70 | xx | 25 |
| 1-2 (Comparative) | Exemplary compound II-5(0.5 g/l) | no addition | 36 | 70 | x | 21 |
| 1-3 (Invention) | no addition | Exemplary compound II-5(0.5 g/l) | 70 | 36 | | 15 |
| 1-4 (Invention) | Exemplary compound II- | Exemplary compound II- | 36 | 36 | Δ— | 18 |

TABLE 1-continued

| Sample No. | Additive (amount) First stabilizing | Additive (amount) Second stabilizing | Surface tension (dyne/cm) First stabilizing | Surface tension (dyne/cm) Second stabilizing | Contamination on film surface*1 | Fading percentage of dye (%) |
|---|---|---|---|---|---|---|
| | 5(0.5 g/l) | 5(0.5 g/l) | | | | |
| 1-5 (This invention) | no addition | Exemplary compound II-6(1 g/l) | 70 | 45 | | 14 |
| 1-6 (This invention) | no addition | Exemplary compound III-3(0.2 g/l) | 70 | 46 | | 17 |
| 1-7 (This invention) | no addition | Exemplary compound III-8(0.5 g/l) | 70 | 29 | | 18 |
| 1-8 (This invention) | no addition | Exemplary compound IV-4(0.5 g/l) | 70 | 23 | | 14 |

*1In the Table, as the degree of contamination, contamination is more as the number of x is greater and indicates no generation of contamination.

From the above Table 1, it can be appreciated that only the samples processed with the first stabilizing solution having a surface tension falling within the range from 20 to 78 dyne/cm and the second stabilizing solution having a surface tension falling within the range from 8 to 60 dyne/cm are surprisingly free from contamination on the film surface and also fading of dye is very excellent.

EXAMPLE 2

(Experiment 1)

In the first stabilizing solution in Example 1 (Samples Nos. 1–5), as a fungicidal means, each 0.4 g/l of fungicides (2-methyl-4-isothiazoline-3-one, sodium-2-pyridinethiol-1-oxide, dodecyldimethylbenzylammonium chloride, or dodecylguanidine) was added, and the same experiment as in Example 1 was carried out. The results are shown in Table 2.

TABLE 2

| Sample No. | fungicide in first stabilizing solution | Contamination on film surface | Fading percentage of dye (%) |
|---|---|---|---|
| 1-5 | none | | 14 |
| 2-1 | 2-methyl-4-isothiazoline-3-one | | 11 |
| 2-2 | sodium-2-pyridinethiol-1-oxide | | 12 |
| 2-3 | dodecyldimethylbenzylammonium chloride | | 12 |
| 2-4 | Dodecylguanidine | | 12 |

From the above Table 2, it can be appreciated that contamination on the film surface can be reduced by addition of the fungicidal means of the present invention and also that the fading percentage of dye can further be improved by reduction.

(Experiment 2)

In the circulation system of the first stabilizing tank in Example 1, a magnet water activator having a permanent magnet (1 and ½ unit, produced by Algarid Co., in Australia) was set, and the same experiment as in Example 1 was conducted. As the result, the same results as described above (Experiment 1) were obtained.

(Experiment 3)

In the first stabilizing tank in Example 1, a UV-ray lamp "GL-15" (wavelength 254 nm) produced by Tokyo Shibaura Denki K.K. was set, and the same experiment as in Example 1 was conducted. As the result, the same results as described above (Experiment 1) were obtained.

EXAMPLE 3

The same experiment as in Example 1 was repeated except for varying the concentration of ammonium thiosulfate in the second stabilizing solution used in Example 2 (Experiment 1) as shown in Table 3.

The results are summarized in Table 3.

TABLE 3

| Sample No. | Thiosalfate conc. in second stabilizing soln. (mole/l) | Contamination on film surface | Fading percentage of magenta density (%) |
|---|---|---|---|
| 3-1 (Comparative) | 0 | | 22 |
| 3-2 (Comparative) | $0.5 \times 10^{-5}$ | | 19 |
| 3-3 (This invention) | $0.7 \times 10^{-5}$ | | 16 |
| 3-4 (This invention) | $2 \times 10^{-5}$ | | 12 |
| 3-5 (This invention) | $50 \times 10^{-5}$ | | 11 |
| 3-6 (This invention) | $100 \times 10^{-5}$ | | 11 |
| 3-7 (This invention) | $200 \times 10^{-5}$ | | 12 |
| 3-8 (This invention) | $1500 \times 10^{-5}$ | Δ – | 14 |
| 3-9 (Comparative) | $2000 \times 10^{-5}$ | x | 18 |

From the above Table 3, it can be seen that both contamination and fading percentage of dye are reduced well when the thiosulfate concentration in the second stabilizing solution is $0.7\times10^{-5}$ to $1500\times10^{-5}$ mole/l, all performances being very good particularly when it is $2\times10^{-5}$ to $200\times10^{-5}$ mole/l.

EXAMPLE 4

A mixture of 5 g of 1-(2,4,6-trichlorophenyl)-3-(2-chloro-5-octadecenylsuccinimidoanilino)-5-pyrazolone as the magenta coupler, 3.0 g of tricresyl phosphate as a high boiling point organic solvent and 20 g of ethyl acetate, and optionally a necessary amount of dimethylformamide was dissolved by heating to 60° C., and then the resultant solution was mixed with 100 ml of an aqueous 5% gelatin solution containing 10 ml of an aqueous 5% solution of Alkanol B (alkylnaphthalenesulfonate, produced by Du Pont Co.), followed by emulsification by a ultrasonic dispersing machine to obtain a dispersion.

Next, the dispersion was added to a silver chlorobromide emulsion (containing 20 mole % silver chloride) sensitized with SD-1 so that the magenta coupler might be 10 mole % based on silver, and further 1,2-bis(vinylsulfonyl)ethane was added as the film hardener at a proportion of 12 mg per gram of gelatin. The mixture obtained was applied on a polyethylene-coated paper support to a coated silver quantity of 4 mg/100 $cm^2$.

The color paper as prepared above was subjected to the experiment by use of the processing solutions and the processing steps shown below.

| Standard processing steps | | |
|---|---|---|
| [1] Color developing (1 tank) | 38° C. | 3 min. 30 sec. |
| [2] Bleach-fixing (1 tank) | 33° C. | 1 min. 30 sec. |
| [3] First stabilizing (3 tanks) | 25–30° C. | 2 min. 30 sec. |
| [4] Second stabilizing (1 tank) | 25–30° C. | 30 sec. |
| [5] Drying | 75–80° C. | ca. 2 min. |

| Compositions of processing solutions | |
|---|---|
| <Color developing tank solution> | |
| Benzyl alcohol | 15 ml |
| Ethylene glycol | 15 ml |
| Potassium sulfite | 2.0 g |
| Potassium bromide | 1.3 g |
| Sodium chloride | 0.2 g |
| Potassium carbonate | 30.0 g |
| Hydroxylamine sulfate | 3.0 g |
| Polyphosphoric acid (TPPS) | 2.5 g |
| 3-Methyl-4-amino-N—ethyl-N—(β-methanesulfonamidoethyl)aniline sulfate | 5.5 g |
| Fluorescent whitening agent (4,4'-diamino-stilbenedisulfonic acid derivative) | 1.0 g |
| Catechol-3,5-disulfonic acid | 0.3 g |
| (made up to one liter with addition of water, and adjusted to pH 10.00 with KOH). | |
| <Supplemental color developing solution> | |
| Benzyl alcohol | 22 ml |
| Ethylene glycol | 20 ml |
| Potassium sulfite | 3.0 g |
| Potassium carbonate | 30.0 g |
| Hydroxylamine sulfate | 4.0 g |
| Polyphosphoric acid (TPPS) | 3.0 g |
| 3-Methyl-4-amino-N—ethyl-N—(β-methanesulfonamidoethyl)aniline sulfate | 7.5 g |
| Fluorescent whitening agent (4,4'-diamino-stilbenedisulfonic acid derivative) | 1.5 g |
| Catechol-3,5-disulfonic acid | 0.3 g |
| (made up to one liter with addition of water, and adjusted to pH 10.50 with KOH). | |
| <Bleach-fixing tank solution> | |
| Ferric ammonium ethylenediaminetetraacetate dihydrate | 60 g |
| Ethylenediaminetetraacetic acid | 3 g |
| Ammonium thiosulfate (70% solution) | 100 ml |
| Ammonium sulfite (40% solution) | 27.5 ml |
| (adjusted to pH 7.1 with potassium carbonate or glacial acetic acid and made up to one liter with addition of water). | |
| <Supplemental bleach-fixing solution A> | |
| Ferric ammonium ethylenediaminetetraacetate dihydrate | 260 g |
| Potassium carbonate | 42 g |
| (made up to one liter with addition of water, and the pH of this solution was adjusted to 6.7 with glacial acetic acid or aqueous ammonium). | |

-continued

| Compositions of processing solutions | |
|---|---|
| <Supplemental bleach-fixing solution B> | |
| Ammonium thiosulfate (70% solution) | 500 ml |
| Ammonium sulfite (40% solution) | 150 ml |
| Ethylenediaminetetraacetic acid | 17 g |
| Glacial acetic acid | 85 ml |
| (made up to one liter with addition of water, and the pH of this solution was adjusted to 4.6 with glacial acetic acid or aqueous ammonium). | |
| <First stabilizing solution and supplemental solution> | |
| 5-Chloro-2-methyl-1-isothiazoline-3-one | 0.03 g |
| 2-Methyl-4-isothiazoline-3-one | 0.03 g |
| (made up to one liter with water and adjusted to pH 7.0). | |
| <Second stabilizing solution and supplemental solution> | |
| Exemplary compound (IV-3) | 0.4 g |
| (made up to one liter with water and adjusted to pH 7.0) | |

(Experiment 4)

In an automatic processing machine, the color developing tank solution, the bleach-fixing tank solution, and the stabilizing solutions as described above were filled and, while processing a color paper subjected to picture printing exposure, the supplemental color developing solutions, the supplemental bleach-fixing solutions A, B and the stabilizing supplemental solutions were supplemented at every three minutes through quantitating cups to carry out continuous processing. The amounts supplemented were, per 1 $m^2$ of the color paper, 170 ml for the color developing tank, each 25 ml of the supplemental bleach-fixing supplemental solutions A and B for the bleach-fixing tank and 300 ml for the stabilizing tanks respectively.

The stabilizing tanks in the automatic processing machine were made the first to the third tanks in the direction of the flow of light-sensitive materials, and a multi-stage countercurrent system was employed in which supplemental solutions were fed into the final tank, overflow from which was permitted to flow to the tank of the preceding stage, and further the overflow from this stage was permitted to flow into the tank of the stage precedent to said stage.

The continuous processing was conducted until the total supplemental stabilizing solution became 3-fold of the stabilizing tank volume to process the color paper sample as prepared above.

The first stabilizing solution in the third tank (the final tank) and the second stabilizing solution after continuous processing were subjected to measurement of surface tension in a conventional manner. Also, contamination on the color paper surface and stain at the unexposed portion were visually observed.

(Experiment 5)

The same experiment as in Experiment 1 was performed except for replacing the second stabilizing solution in the above Experiment 1 with water.

(Experiment 6)

The above Experiment 1 was repeated except that the second stabilizing solution was removed to omit processing with the second stabilizing solution.

(Experiment 7)

The above Experiment 1 was repeated except that the first stabilizing solution was removed to omit processing with the first stabilizing solution.

The results are summarized in Table 4.

TABLE 4

| Sample No. | Additive in second solution | Surface tension (dyne/cm) First stabilizing soln. | Surface tension (dyne/cm) Second stabilizing soln. | Contamination on color paper surface | Stain at unexposed portion |
|---|---|---|---|---|---|
| 4-1 (This invention) | Exemplary compound (IV-3) | 68 | 24 | | |
| 4-2 (Comparative) | no addition | 68 | 69 | Δ | x |
| 4-3 (Comparative) | none | 68 | — | Δ | x |
| 4-4 (Comparative) | Exemplary compound (IV-3) | — | 32 | x | Δ |

(In the above Table means good, x inferior and Δ slightly inferior)

From the above Table 4, it can be understood that slightly inferior or inferior results of contamination on color paper surface and stain are obtained by use of either one of the first stabilizing solution and the second stabilizing solution, and further that both of the above performances are good only when the surface tensions of the first and the second stabilizing solutions are controlled to 20–78 dyne/cm and 8–60 dyne/cm, respectively.

EXAMPLE 5

The experiments were conducted in the same manner as in Example 4 except for using the exemplary compound (I-12) in place of the sensitizing dye (SD-1) used in the color paper in Example 4. As the result, contamination on the color paper surface was reduced well, and stain reduction was further improved.

We claim:

1. A method for processing a light-sensitive silver halide color photographic material, which comprises processing the light-sensitive silver halide color photographic material subjected to imagewise exposure with a processing solution having developing ability, a processing solution having fixing ability, and thereafter sequentially processing said material with a first aqueous stabilizing solution comprising a first surfactant in an amount effective to give to the first aqueous solution a surface tension of 20 to 78 dyne/cm and then with a second aqueous stabilizing solution comprising a second surfactant in an amount effective to give to the second aqueous stabilizing solution a surface tension of 8 to 60 dyne/cm, substantially without performing a water washing step after the processing with the solution having fixing ability, said first surfactant and said second surfactant being the same or different; and wherein each of said first and second light-sensitive silver halide photographic materials contains at least one of the compounds represented by the formula (I) below:

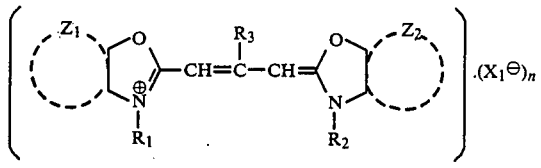

(I)

wherein each of $Z_1$ and $Z_2$ represents a group of atoms necessary for formation of a benzene ring or a naphthalene ring fused to the oxazole ring; each of $R_1$ and $R_2$ represents an alkyl group, an alkenyl group or an aryl group; $R_3$ represents a hydrogen atom or an alkyl group having 1 to 3 carbon atoms; $X_1\ominus$ represents an anion; and n is 0 or 1.

2. The method for processing a light-sensitive silver halide photographic material according to claim 1, wherein the second stabilizing solution contains $0.7\times10^{-5}$ mole/l of a thiosulfate.

3. The method for processing a light-sensitive silver halide photographic material according to claim 1, wherein the first stabilizing solution has a surface tension of 50 to 75 dyne/cm.

4. The method for processing a light-sensitive silver halide photographic material according to claim 1, wherein the second stabilizing solution has a surface tension of 15 to 45 dyne/cm.

5. The method for processing a light-sensitive silver halide photographic material according to claim 1, wherein the first stabilizing solution and the second stabilizing solution have a pH of 4 to 9.

6. The method for processing a light-sensitive silver halide photographic material according to claim 1, wherein the first stabilizing solution contains a chelating agent having a chelate stability constant with iron (III) ions of 8 or more.

7. The method for processing a light-sensitive silver halide photographic material according to claim 2, wherein the second stabilizing solution contains $2\times10^{-5}$ to $200\times10^{-5}$ mole/l of a thiosulfate.

8. The method for processing a light-sensitive silver halide photographic material according to claim 1 wherein the amount of each of said first and said second stabilizing solutions used in said processing being up to 6000 ml per 1 $m^2$ of said light-sensitive material.

9. The method for processing a light-sensitive silver halide photographic material according to claim 1, wherein said second surfactant is selected from the group consisting of a compound of formula (II) shown below and a compound of formula (III) shown below, and a water-soluble organic siloxane compound:

$$A-O-(B)_m-X_2 \quad \text{(II)}$$

wherein A represents a monovalent organic group, B represents ethylene oxide or propylene oxide, m represents an integer of 4 to 50, $X_2$ represents a hydrogen atom, $SO_3Y$ or $PO_3Y_2$, and Y represents a hydrogen atom, an alkali metal or an ammonium ion;

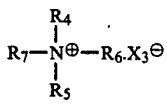

(III)

wherein each of $R_4$, $R_5$ $R_6$ and $R_7$ represents a hydrogen atom, an alkyl group or a phenyl group, with the total number of the carbon atoms of $R_4$, $R_5$, $R_6$ and $R_7$ being 3 to 50 and $X_3$ represents an anion.

10. The method for processing a light-sensitive silver halide photographic material according to claim 1, wherein said second stabilizing solution contains as said surfactant the water-soluble organic siloxane compound represented by the formula (IV) shown below:

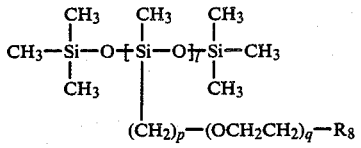

(IV)

wherein $R_8$ represents a hydrogen atom, a hydroxy group, a lower alkyl group, an alkoxy group,

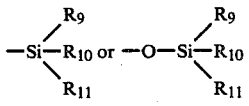

represents a lower alkyl group, said $R_9$, $R_{10}$ and $R_{11}$ being either the same or different, l represents an integer of 1 to 4, and each of p and q represents an integer of 1 to 15.

11. A method for processing a light-sensitive silver halide photographic material according to claim 1, wherein said compound represented by formula (I) is

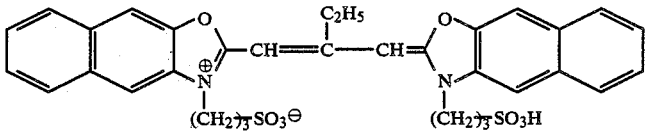

12. A method for processing a light-sensitive silver halide photographic material according to claim 1, wherein said first stabilizing solution contains a surfactant having the formula

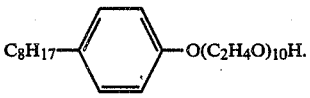

II-5

13. A method for processing a light-sensitive silver halide photographic material according to claim 9, wherein each of said first stabilizing solution and said second stabilizing solution contains as surfactant

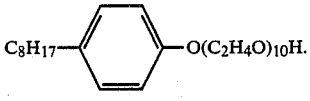

II-5

14. The method for processing a light-sensitive silver halide photographic material according to claim 1, wherein said second stabilizing solution contains as surfactant

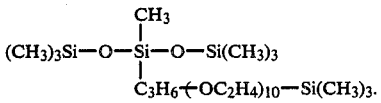

IV-4

15. The method for processing a light-sensitive silver halide photographic material according to claim 1, wherein said first stabilizing solution and said second stabilizing solution are not admixed during processing.

16. The method for processing a light-sensitive silver halide photographic material according to claim 1, wherein the amount of each of said first and second stabilizing solutions used in said processing is from 20 ml to 4000 ml per $m^2$ of said light-sensitive material.

17. The method for processing a light-sensitive silver halide photographic material according to claim 1, wherein the first stabilizing solution is fungicidally treated by at least one of (A) adding a fungicide, (B) passing through a magnetic field, and (C) irradiation with UV radiation.

18. The method for processing a light-sensitive silver halide photographic material according to claim 17, wherein said first stabilizing solution is treated by adding a fungicide.

19. The method for processing a light-sensitive silver halide photographic material according to claim 4, wherein said first stabilized solution has a surface tension of from 50–75 dyne/cm.

* * * * *

UNITED STATES PATENT AND TRADEMARK OFFICE

CERTIFICATE OF CORRECTION

PATENT NO. : 4,778,748

DATED : October 18. 1988

INVENTOR(S) : KUSE et al

It is certified that error appears in the above-identified patent and that said Letters Patent is hereby corrected as shown below:

In the title page. under "References Cited":

Replace USP "4,279,880" with --4,279,990--.

Column 25, line 65 (claim 1):

Delete the words "each of" and "first and second".

Column 25, line 66 (claim 1):

Change "materials" to --material--.

Signed and Sealed this

Fifth Day of May, 1992

*Attest:*

DOUGLAS B. COMER

*Attesting Officer*

*Acting Commissioner of Patents and Trademarks*